US005181439A

United States Patent [19]

Schwartz

[11] Patent Number: 5,181,439

[45] Date of Patent: Jan. 26, 1993

[54] COMMUNICATIVE TOOLS AND FASTENERS

[76] Inventor: Jimmy R. Schwartz, 1116 Willow Creek, Zachary, La. 70791

[21] Appl. No.: 518,484

[22] Filed: May 3, 1990

Related U.S. Application Data

[63] Continuation of Ser. No. 227,670, Aug. 2, 1988, abandoned.

[51] Int. Cl.[5] ..... B25B 23/02

[52] U.S. Cl. ..... 81/119; 81/436; 81/DIG. 5

[58] Field of Search ..... 81/119, DIG. 5, 436, 81/121.1

[56] References Cited

U.S. PATENT DOCUMENTS

| | | | |
|---|---|---|---|
| 1,984,839 | 12/1934 | Murray | 81/DIG. 5 |
| 4,417,488 | 11/1983 | Gentry | 81/124.4 |
| 4,455,898 | 6/1984 | Marbourg, Jr. | 81/454 |
| 4,800,786 | 1/1989 | Arnold et al. | 81/121.1 |
| 4,982,627 | 1/1991 | Johnson | 81/177.1 |

OTHER PUBLICATIONS

Jensen Fall Catalog 1977; p. 104, "Hollow-Shaft Nut-drivers".

Playskool Big, Big Tool Bench (1 page), Copyright 1984.

Playskool Workbench (2 pages), Copyright 1986.

*Primary Examiner*—Bruce M. Kisliuk
*Assistant Examiner*—Lawrence Cruz
*Attorney, Agent, or Firm*—John F. Sieberth

[57] ABSTRACT

Described is a combination of fasteners and tools which visually communicate their respective sizes to the user so clearly that by merely glancing at these objects a tool matching the fastener or a fastener that matches the tool can readily be selected for use. This beneficial result is achieved by visually coding the fasteners of different sizes either by a pattern or preferably by color so that all fasteners of a given size bear one distinguishing visual appearance, all fasteners of another given size bear another distinguishing visual appearance, and so on.

14 Claims, 1 Drawing Sheet

COMMUNICATIVE TOOLS AND FASTENERS

REFERENCE TO RELATED APPLICATION

This is a continuation of prior copending application Ser. No. 227,670 filed Aug. 2, 1988 and now abandoned.

TECHNICAL FIELD

This invention relates in general to fasteners and tools for applying or removing them, and more particularly to rotatable fasteners and tools therefor which are adapted to communicate to the person applying or removing the fasteners so as to expedite the operation.

BACKGROUND

As is well known, fasteners such as machine screws, bolts, and the like are applied and removed by means of such tools as open-ended wrenches, box wrenches, socket wrenches, and Allen wrenches which may be operated by hand or by means of suitable power equipment. Oftentimes the tools are carried in tool boxes or cribs and the fasteners in various containers, and it is a matter of common experience that it is frequently necessary to fish around in the tool box to find a tool appearing to match the size of the fastener being applied or removed, only to find that the tool is of the wrong size so that this time-consuming and frustrating procedure may have to be repeated a number of times until the tool has been found that matches the size of the fastener. Even though the tools may have their sizes marked on them, the tools often become jumbled up in the tool box or crib and thus it is troublesome to find the appropriately sized tool. Complicating this problem is the fact that oftentimes the operator is working in dimly lit areas so that such size markings cannot readily be seen. Moreover fasteners usually do not have their sizes marked on them and thus the operator has to make a guess as to the proper size of tool needed.

The resultant cumulative loss of time, especially on large sized or repetitive jobs such as in manufacturing or assembly plants, on construction sites and in repair shops can be extremely costly and constitutes a serious loss of productivity.

THE INVENTION

A simple, efficient, economical way of overcoming the above problems has now been found. This invention makes it possible to avoid the loss of time and productivity and eliminate the waste motion and frustrations that have been experienced heretofore because of a lack of a suitable way of coping with these problems.

Pursuant to this invention there is provided a combination of fasteners and tools which visually communicate their respective sizes to the user so clearly that by merely glancing at these objects a tool matching the fastener or a fastener that matches the tool can readily be selected for use. This beneficial result is achieved by visually coding the fasteners of different sizes either by a pattern or preferably by color so that all fasteners of a given size bear one distinguishing visual appearance, all fasteners of another given size bear another distinguishing visual appearance, and so on. For example all nuts, bolts, machine screws or the like of say ¼-inch size may be colored red, all such fasteners of 5/16-inch size may be colored black, all such fasteners of ⅜-inch size may be colored white, all such fasteners of 7/16-inch size may be colored blue, and so on. Similarly, the tools, such as open-ended wrenches, box wrenches, sockets of socket wrenches, and Allen wrenches may be provided with colors matching those of the correspondingly-sized fasteners. Thus in the example given the ¼-inch wrenches and/or sockets would bear a red coloration, the 5/16-inch wrenches and/or sockets a black coloration, the ⅜-inch wrenches and/or sockets a white coloration, the 7/16-inch wrenches and/or sockets a blue coloration, and so on. Naturally this same system can be applied to metric sized tools and fasteners as well.

An alternative to use of colors is the marking of the tools and correspondingly-sized fasteners with various distinctive markings or patterns which are readily perceivable by the eye, such as one or more dots for one size tool and fastener, one or more squares for another size tool, one or more parallel straight lines for still another size tool and fastener, and so on using various geometric shapes and patterns that are readily discernable and distinguishable at a glance, such as triangles, crescents, crosses, zig-zag lines, etc.

Whether using colors or distinctive markings or patterns on the tools and correspondingly sized fasteners for effecting the communication to the user, it is not necessary that the entire series of sizes (whether U. S. or metric, or both) involve completely different matched colors or distinctive markings or patterns, although this is preferred pursuant to this invention. Instead, the series of colors or distinctive markings or patterns may be repeated in the same sequence two or more times, once for the group of smallest size fasteners and tools, once again for a next group of successively larger sized fasteners and tools, and so on. For example, a repetitive series such as the following may be employed:

| Size, in inches | Color on Tools and Fasteners |
|---|---|
| ¼ | Red |
| 5/16 | Black |
| ⅜ | White |
| 7/16 | Blue |
| ½ | Yellow |
| 9/16 | Violet |
| ⅝ | Gray (or Silver) |
| 11/16 | Green |
| ¾ | Orange |
| 13/16 | Tan |
| ⅞ | Pink |
| 15/16 | Brown |
| 1 | Red |
| 1 & 1/16 | Black |

and so on. In such a repetitive series a ¼ inch tool or fastener can easily be distinguished in size from a 1-inch tool or fastener and thus both can bear the same coloration (in this case, red). Likewise, in this illustrative series the tools and fasteners colored black (5/16-inch and 1 & 1/16-inch can equally well be distinguished visually by size. Yet in all cases closely-sized tools and fasteners which cannot readily be distinguished by size can be distinguished by the matching colorations so that the desired size tool to match the fastener, or vice versa, can be selected quickly and accurately.

As noted above, it is not necessary to use a repetitive series such as colorations tabulated above. Instead each sized fastener and correspondingly-sized tool can have its own distinctive coloration and/or marking(s). In this case of colors, use may be made of different shades of the same colors in order to extend the series, such as by using for one size a dark blue and for another size a light blue, for still another size a dark green and yet another size a light green, and so on. In deed, there are a wide variety of sufficiently different colors as to make match-ups and distinctions quite easy in practice.

Combinations of colors and distinctive markings or patterns may be employed, if desired. Thus for example the correspondingly-sized tools and fasteners may have one or more dots of the color sequence, say from ¼ through 15/16-inch as given in the above table, and the next larger group (starting at 1-inch) may have one or more triangles of this same color sequence, and the next successively larger group may be marked with stars of this same color sequence, and so on.

When utilizing this invention with tools and fasteners of both U. S. sizes and metric sizes, it is desirable to use a coloration system for either the group of U. S. or the group of metric tools and fasteners, and to use a system of markings or patterns for the other group of tools and fasteners. In this way the user knows at a glance which system of size measurements is involved, and either the colors or the markings (whichever apply) can easily be used to match up like sized tools and fasteners and to simultaneously distinguish these from all other sized tools and fasteners (or least all other closely sized tools and fasteners).

The colors, markings and/or patterns may be applied by use of suitably tough, adherent, and durable paints or other coatings. Electically deposited coatings, as well as coatings applied by means of dipping, spraying, etc. are illustrative of the types of colored coatings that may be employed for this purpose. Alternatively, the coloration may be incorporated into the materials from which the tools or fasteners are manufactured, as by use of suitable pigments capable of withstanding the conditions used in the manufacture of the tools and fasteners. Usually the fasteners and tools are fabricated from metals, although newer space-age materials having the requisite physical properties may be used, such as certain reinforced ceramic materials, high-strength engineering plastic materials, and the like.

In the accompanying Drawing:

FIGS. 1A, 1B, and 1C depict the tops of three different sized machine screws or bolts having hexagonal heads;

FIGS. 2A, 2B, and 2C depict, in fragmentary form, the ends of three open-ended wrenches sized to match the machine screws or bolts of FIGS. 1A, 1B, and 1C, respectively;

Figure 1A:
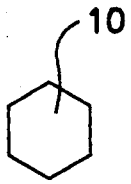
Figure 1B:
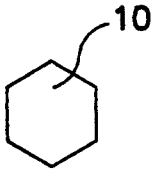
Figure 1C:
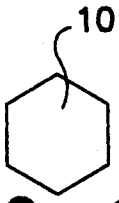
Figure 3:
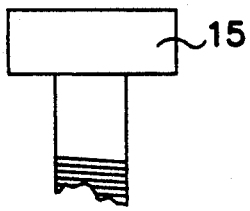
FIG. 3 depicts, in fragmentary form and in side view, the upper part of a machine screw or bolt having a square head.

As can be seen from FIGS. 1A, 1B, and 1C, the top surface 10 of the head of the machine screw or bolt (or other like fastener) serves as a highly suitable location for distinctive coloration, marking(s), and/or pattern(s) to be applied as surface 10 is readily visible even when the fastener is in place. If desired, the distinctive coloration, marking(s), and/or pattern(s) may also be located on the perimeter surface area 15 (note FIG. 3), of which there are, of course, four in the case of a square-headed machine screw or bolt (as illustrated) and which would number six in the case of machine screws or bolts having hexagonal heads (not illustrated in FIG. 3). Indeed, the entire head and even the entire fastener may be distinctively colored or bear the distinctive marking(s) or pattern(s). The main requirement is that such coloration, marking(s), and/or pattern(s) be readily seen when the fastener is in place as this facilitates selection of the proper sized tool when it is desired to loosen or remove the fastener.

In order to distinguish among the sizes of the three fasteners depicted in FIGS. 1A, 1B, and 1C, at least a portion (preferably all) of at least the top surface 10 of the fastener of FIG. 1A may, for example, be colored red, at least a portion (preferably all) of at least the top surface 10 of the fastener of FIG. 1B may, for example, be colored black, and at least a portion (preferably all) of at least the top surface 10 of the fastener of FIG. 1C may, for example, be colored white. Other sized fasteners (not shown) may bear other distinctive colorations, as previously explained. Alternatively, at least a portion (preferably all) of at least the top surface 10 of the fastener of FIG. 1A may, for example, be marked with one or more suitably-sized dots, at least a portion (preferably all) of at least the top surface 10 of the fastener of FIG. 1B may, for example, be marked with one or more suitably-sized triangles, and at least a portion (preferably all) of at least the top surface 10 of the fastener of FIG. 1C may, for example, be marked with one or more suitably-sized stars, and other distinguishing markings or patterns may be similarly applied to other sized fasteners (not shown).

Figure 2A:
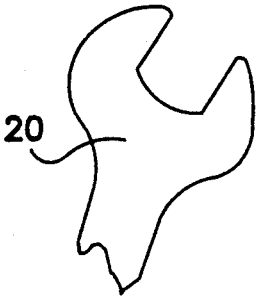
Figure 2B:
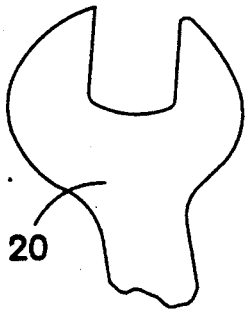
Figure 2C:
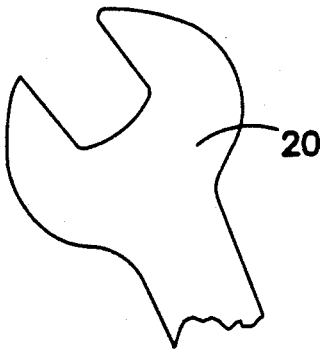

FIGS. 2A, 2B, and 2C depict operative end portions of open-ended wrenches sized to match the head sizes of the fasteners of FIGS. 1A, 1B, and 1C, respectively. In accordance with the illustrative versions herein discussed with reference to the Drawing, and assuming that distinctive colorations in lieu of distinctive markings are used on the fasteners of FIGS. 1A, 1B, and 1C, all or a portion of at least an end portion 20 of the wrench of FIG. 2A may be colored to match the coloration of the fastener of FIG. 1A (in this case, red), all or a portion of at least an end portion 20 of the wrench of FIG. 2B may be colored to match the coloration of the fastener of FIG. 1B (in this case, black), and all or a portion of at least an end portion 20 of the wrench of FIG. 2C may be colored to match the coloration of the fastener of FIG. 1C (in this case, white). In the alternative illustrative case discussed above wherein distinctive markings are employed on the fasteners, these same distinctive markings will be present on the correspondingly-sized tools. Thus in the example herein given, all or a portion of at least an end portion 20 of the wrench of FIG. 2A would be marked with one or more suitably-sized dots to match the marking(s) on the fastener of FIG. 1A, all or a portion of at least an end portion 20 of the wrench of FIG. 2B would be marked with one or more suitably-sized triangles to match the marking(s) on the fastener of FIG. 1B, and all or a portion of at least an end portion 20 of the wrench of FIG. 2C would be marked with one or more suitably-sized stars to match the marking(s) on the fastener of FIG. 1C.

The same general considerations illustrated with reference to the Drawing apply equally well to the coloration or marking of the sockets of socket wrenches to match the colorations of the correspondingly-sized fasteners, the coloration or marking of box wrenches to match the colorations of the correspondingly-sized fasteners, the coloration or marking of combined (i.e., unitary) open-ended and box box wrenches to match the colorations of the correspondingly-sized fasteners, the coloration or marking of Allen wrenches to match the colorations of the correspondingly-sized fasteners adapted to be tightened or loosened by means of Allen wrenches, and so on. Indeed, the same general principles may be utilized with other fasteners and tools therefor, such as Phillips screws and screwdrivers, and the like.

Figure 4:
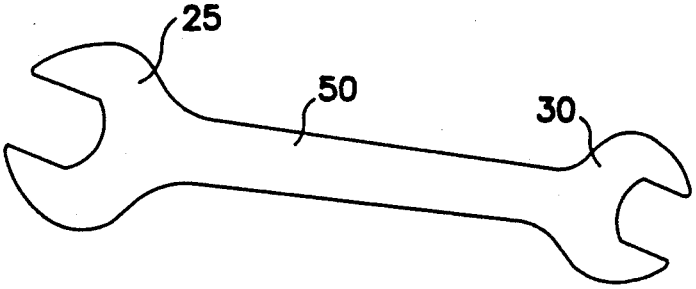
FIG. 4 depicts an open-ended wrench for use with fasteners of two different sized heads.

FIG. 4 illustrates an embodiment which applies not only to double open-ended wrenches (i.e., open-ended wrenches having means for engaging one sized fastener at one end and fasteners of a different size at its other end, as illustrated in FIG. 4), but to double-ended box wrenches as well (i.e., box wrenches having means for engaging one sized fastener at one end and fasteners of a different size at its other end). In these tools one distinctive coloration or marking(s) is applied to end portion 25 and another distinctive coloration or marking(s) is applied to end portion 30, the coloration or marking(s) at end portion 25 matching fasteners of that size wrench opening and the coloration or marking(s) at end portion 30 matching fasteners of that size wrench opening. Thus the wrench (whether a double open-ended wrench or a double-ended box wrench) would have different colors or marking(s) at its respective end portions. Moreover other double open-ended wrenches or double-ended box wrenches of still other sizes would bear still other distinguishing colors or marking(s) at their respective end portions. Preferably the color and/or marking(s) appear at least on both faces (sides) of the end portions so that the color and/or marking(s) can be seen irrespective of how the tools may be jumbled up in a tool box or crib. In short, the face of end portion 25 facing the viewer in FIG. 4 and the face of end portion 25 on the reverse or down side of the wrench (not visible in FIG. 4) should both carry the same coloration and/or markings. The same holds true for the opposite faces of end portion 30 although of course the coloration and/or marking(s) which these end portion faces both carry will differ from the coloration and/or marking(s) carried by the faces of end portion 25.

In the case of unitary box and open-ended wrenches (i.e., those in which one end portion is an open-ended wrench such as end portion 25 of FIG. 4 and the other end portion is an equally-sized box wrench (in lieu of end portion 30 in FIG. 4), the distinctive coloration and/or markings of the entire tool may be located at the front and back faces of the respective end portions, at all or part of the median handle portion 50 (note FIG. 4), or on all or any combination of these. Another differently-sized unitary box and open-ended wrench would be similarly colored and/or marked, but in a different color and/or with different markings from the color and/or markings of the first-mentioned unitary box and open-ended wrench.

Figure 5:
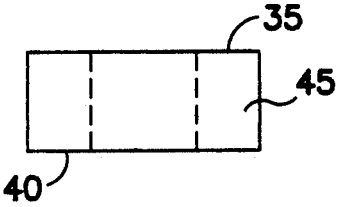
FIG. 5 depicts in side view a square nut.

FIG. 5 illustrates the positions where the coloration and/or marking(s) may be located on nuts, whether square (as depicted) or hexagonal. In particular, the coloration and/or marking(s) may be located on the top portion 35, the bottom portion, or some or all of the four or six side portions 45 of the nut, or any combination of these. Naturally, the more extensive the area covered by such coloration and/or marking(s), the easier it is to detect visually. Preferably at least the surface of the nut facing outwardly when the nut is fastened in place on a bolt or threaded stud should possess such coloration and/or marking(s). Most preferably the top portion 35, the bottom portion 40 and all side portions 45 will possess such coloration and/or marking(s).

The principles of visual coding described above can also be utilized in matching up sockets of socket wrenches with their drivers such as ¼, ⅜ and ½-inch driver ratchets. For example a ¼-inch drive rachet may be used with sockets ranging in size from, say, 3/16-inch up to 11/16 whereas a ⅜-inch drive rachet may be used with sockets ranging from ⅜ to 1-inch in size. Thus in accordance with this invention the ¼-inch drive rachet may be appropriately marked or colored, for example red, and all of the sockets that can be used with this sized rachet would also be visually marked or colored in the same fashion, namely in this illustrative example, with red coloration on at least a portion thereof that accommodates the rachet. The portion of the socket that receives the fastener would be visually coded to match the code used on the correspondingly-sized fasteners.

Likewise, in this illustrative example, the ⅜-inch rachet may be colored white and all of the sockets sized to fit this drive rachet would also be colored white on portions thereof that fit with this sized rachet. Here again the portions of the sockets that accommodate the fasteners would be visually coded so that the correspondingly-sized socket and fasteners would have the same distinctive coloration or marking.

The foregoing disclosure has been presented for purposes of illustration and not limitation. As can readily be appreciated by those skilled in the art, this invention is susceptible to considerable variation in its practice within the spirit and scope of the ensuing claims.

What is claimed is:

1. Articles of manufacture comprising:

(a) a plurality of rotatable fasteners each having a head portion, said fasteners including at least a first fastener of a given kind and a second fastener of the same kind as the first fastener but differing therefrom in that the respective head portions of the first fastener and of the second fastener differ in size from each other; and (b) a plurality of tools for rotating such fasteners, each such tool having a head-engaging portion of a given size for engaging a fastener head portion of a given size in order to enable such fastener to be rotated by means of the tool, said tools including at least a first tool of a given kind and a second tool of the same kind as the first tool but differing therefrom in that the respective head-engaging portions of the first tool and of the second tool correspond in size to the head size of the first and second fasteners, respectively; at least some of the exterior of the head portion of said first fastener and at least some of the exterior of said first tool each having affixed thereto readily perceptible, visually perceptible matching indicia signifying correspondence of size therebetween, and at least some of the exterior of the head portion of said second fastener and at least some of the exterior of said second tool each having affixed thereto readily perceptible, visually perceptible matching indicia signifying correspondence of size therebetween, said matching indicia affixed to said first fastener and tool being visually distinguishable from said matching indicia affixed to said second fastener and tool.

2. Articles in accordance with claim 1 wherein said matching indicia affixed to said first fastener and tool and said matching indicia affixed to said second fastener and tool are visually distinguishable in color.

3. Articles in accordance with claim 1 wherein said matching indicia affixed to said first fastener and tool are tough, adherent and durable coatings of paint of a first color, and said matching indicia affixed to said second fastener and tool are tough, adherent and durable coatings of paint of a second color, the colors of said coatings of paint being different and visually distinguishable from each other.

4. Articles in accordance with claim 1 wherein said matching indicia affixed to said first fastener and tool are pigments of a first color incorporated into said first fastener and tool such that said first fastener and tool possess a readily perceptible, visually perceptible first coloration, and said matching indicia affixed to said second fastener and tool are pigments of a second color incorporated into said second fastener and tool such that said second fastener and tool possess a readily perceptible, visually perceptible second coloration, the colors of said first and second colorations being different and visually distinguishable from each other.

5. Articles in accordance with claim 2 wherein the tools are wrenches, and wherein the fasteners are machine screws in which the distinguishable colors thereof exist on or in at least a portion of the heads thereof.

6. Articles in accordance with claim 2 wherein the tools are wrenches, and wherein the fasteners are bolts in which the distinguishable colors thereof exist on or in at least a portion of the heads thereof.

7. Articles in accordance with claim 2 wherein the tools are wrenches, and wherein the fasteners are nuts in which the distinguishable colors thereof exist on or in at least a portion of the tops, bottoms or sides thereof.

8. Articles in accordance with claim 1 wherein the tools and fasteners include (i) a plurality of differently sized tools and fasteners wherein the sizing thereof is in accordance with a system based on inches and fractions thereof, and (ii) a plurality of differently sized tools and fasteners wherein the sizing thereof is in accordance with the metric system;

said matching indicia affixed to the tools and fasteners of (i) differentiating respective matched sizes of tool and fasteners of one size from respective matched sizes of tool and fasteners of another size either by (1) a group of visually distinguishable colors, or (2) a group of visually distinguishable patterns or markings, and said matching indicia affixed to the tools and fasteners of (ii) differentiating respective matched sizes of tool and fasteners of one size from respective matched sizes of tool and fasteners of another size by whichever of the groups of (1) and (2) that is not affixed to the tools and fasteners of (i).

9. A plurality of rotatable fasteners each having a head portion, said fasteners including fasteners of the same kind but which differ by having at least two different respective head sizes, each of the fasteners of one given head size having a given coloration on at least part of the exteriors of the heads thereof, and each of the fasteners of another given head size having a given coloration on at least part of the exteriors of the heads thereof, the respective colorations being visually distinguishable from each other, whereby said fasteners can readily be matched with a matching sized fastener-rotating tool when such tool bears a matching coloration on at least a portion of its exterior.

10. Articles in accordance with claim 9 wherein the fasteners are machine screws in which the distinguishable colorations thereof exist on or in at least a portion of the heads thereof.

11. Articles in accordance with claim 9 wherein the fasteners are bolts in which the distinguishable colorations thereof exist on or in at least a portion of the heads thereof.

12. Articles in accordance with claim 9 wherein the fasteners are nuts in which the distinguishable colorations thereof exist on or in at least a portion of the tops, bottoms or sides thereof.

13. A plurality of tools for rotating rotatable fasteners each having a head portion, each such tool having a head-engaging portion of a given size for engaging a fastener head portion of a given size in order to enable such fastener to be rotated by means of the tool, said tools including tools of the same kind but which differ by having at least two different respective fastener head-engaging sizes, the tool(s) of a given size having a given coloration on at least part of the exterior(s) thereof, the tool(s) of another given size having a given coloration on at least part of the exterior(s) thereof, the respective colorations being visually distinguishable from each other, whereby said tools can readily be matched with a fastener having a matching sized head portion when such fastener bears a matching coloration on at least a portion of its exterior.

14. Articles in accordance with claim 13 wherein the tools are wrenches.

* * * * *